US007938128B2

(12) United States Patent
Gueret

(10) Patent No.: US 7,938,128 B2
(45) Date of Patent: May 10, 2011

(54) KIT FOR MAKING UP THE EYELASHES, INCLUDING AN APPLICATOR DEVICE WITH A HEATER

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 542 days.

(21) Appl. No.: 12/068,432

(22) Filed: Feb. 6, 2008

(65) Prior Publication Data

US 2009/0020133 A1 Jan. 22, 2009

Related U.S. Application Data

(60) Provisional application No. 60/891,819, filed on Feb. 27, 2007.

(30) Foreign Application Priority Data

Feb. 6, 2007 (FR) ..... 07 53096

(51) Int. Cl.

| | |
|---|---|
| ***A45D 24/22*** | (2006.01) |
| ***A45D 40/26*** | (2006.01) |
| ***A45D 40/30*** | (2006.01) |
| ***A46B 11/08*** | (2006.01) |

(52) U.S. Cl. ..... 132/200; 132/218; 132/216; 401/1; 401/118; 401/126

(58) Field of Classification Search ..... 132/218, 132/216, 217, 212, 220, 294, 295, 320, 200; 401/1, 118, 119, 126, 127, 129, 130; 219/222, 219/227–229

See application file for complete search history.

(56) References Cited

U.S. PATENT DOCUMENTS 2,460,317 A * 2/1949 Tuttle et al. ..... 132/217

(Continued)

FOREIGN PATENT DOCUMENTS

EP 1 430 868 A1 6/2004

(Continued)

*Primary Examiner* — Cris L Rodriguez
*Assistant Examiner* — Vanitha Elgart
(74) *Attorney, Agent, or Firm* — Oliff & Berridge, PLC

(57) ABSTRACT

A kit is provided having an applicator device including a heater and a composition for application to the eyelashes. The composition presents at least one property that varies as a function of temperature and is contained in an applicator endpiece of a shape that is adapted to being fitted to the heater, or the composition is contained in a receptacle in the form of a powder in which the heater can be immersed so as to be loaded with composition.

52 Claims, 10 Drawing Sheets

U.S. PATENT DOCUMENTS

| | | | | |
|---|---|---|---|---|
| 2,630,516 | A | 3/1953 | Rausch et al. | |
| 2,760,264 | A * | 8/1956 | Javits | 30/131 |
| 5,657,778 | A * | 8/1997 | Gueret | 132/320 |
| 5,775,344 | A * | 7/1998 | Clay | 132/218 |
| 5,794,632 | A | 8/1998 | Gueret | |
| 6,565,276 | B1 * | 5/2003 | Diaz | 401/129 |
| 7,083,347 | B2 * | 8/2006 | Marcotte et al. | 401/1 |
| 7,108,438 | B2 * | 9/2006 | Fontaine | 401/1 |
| 7,322,366 | B2 * | 1/2008 | Cho | 132/217 |
| 7,465,114 | B2 * | 12/2008 | Kress et al. | 401/129 |
| 7,597,495 | B2 * | 10/2009 | Gueret | 401/130 |
| 7,637,265 | B2 * | 12/2009 | Funatsu et al. | 132/218 |
| 7,753,609 | B2 * | 7/2010 | Bouix et al. | 401/129 |
| 2005/0031400 | A1 | 2/2005 | Marcotte et al. | |
| 2005/0058496 | A1 * | 3/2005 | De La Poterie et al. | 401/1 |
| 2006/0032512 | A1 * | 2/2006 | Kress et al. | 132/218 |
| 2008/0216857 | A1 * | 9/2008 | Tranchant et al. | 132/218 |
| 2008/0236608 | A1 * | 10/2008 | Tranchant et al. | 132/218 |
| 2009/0007929 | A1 * | 1/2009 | Kress | 132/218 |
| 2009/0025746 | A1 * | 1/2009 | Kim et al. | 132/217 |
| 2009/0159583 | A1 * | 6/2009 | Duru | 219/201 |
| 2010/0043817 | A1 * | 2/2010 | Haan | 132/211 |

FOREIGN PATENT DOCUMENTS

| | | | |
|---|---|---|---|
| EP | 1 468 627 | A1 | 10/2004 |
| EP | 1 468 628 | A1 | 10/2004 |
| FR | 2 733 398 | | 10/1996 |
| WO | WO 2006/037904 | A1 | 4/2006 |
| WO | WO 2006/043544 | A1 | 4/2006 |
| WO | WO 2006/057071 | A1 | 6/2006 |
| WO | WO 2006/057438 | A1 | 6/2006 |
| WO | WO 2006/057439 | A1 | 6/2006 |

* cited by examiner 33
11
30
Y
32
35
31
34

11
15
35
30

11
15
35

11
15

11
15

11
15

31
34
33
20
30
22

11b
15
11a
11

20
21
X
23
I
22

20

20

20

20

20

37
11
15
37

11
15

20

20
29
28

22
20

38
21
20
11
15

20
38
30
15
11

KIT FOR MAKING UP THE EYELASHES, INCLUDING AN APPLICATOR DEVICE WITH A HEATER

This non provisional application claims the benefit of French Application No. 07 53096 filed on Feb. 6, 2007 and U.S. Provisional Application No. 60/891,819 filed on Feb. 27, 2007.

The present invention relates to making up the eyelashes.

The invention seeks more particularly, but not exclusively, to physically lengthen the eyelashes.

BACKGROUND

U.S. Pat. No. 2,630,516 discloses a curling iron for curling the eyelashes, the iron being provided externally with a sheath made of fibrous material, preferably chamois leather, with a view to retaining surplus mascara. In that patent, the heat serves to set the mascara.

EP 1 468 627 A1 describes a heating applicator for applying a viscous composition having a particular thermal profile. The composition is deposited on the applicator by immersing the applicator in a flask containing the composition and provided with a wiper member.

It is known from the publications WO 2006/043544, WO 2006/057438, WO 2006/057439, and WO 2006/057071 to apply a mascara composition to the eyelashes by means of a heated applicator device.

The devices disclosed in those publications are relatively complex and relate more to curling the eyelashes than to lengthening them.

In order to obtain a lengthened effect for the eyelashes, it is known to use a mascara composition that includes fibers. When the fibers are sufficiently rigid and visible, and when they are located at the end of the eyelashes, they can lengthen the eyelashes. The increase in length obtained by such a composition remains moderate, since it is relatively difficult to orientate fibers at the ends of the eyelashes.

As disclosed in WO 2006/037904 A1, another solution can consist in using a mascara composition that presents non-zero magnetic susceptibility, and in creating a magnetic field in the vicinity of the eyelash, thereby making it possible to act on the composition present on the eyelash so as to lengthen said eyelash by a magnetic attraction effect.

Another possibility consists in using a mascara composition that presents a thread-forming characteristic at ambient temperature, as disclosed in application EP 1 430 868 A1. Such a composition can however turn out to be relatively difficult to apply, since mastering the length of the threads formed at the ends of the eyelashes turns out to be tricky.

The Applicant has developed mascara compositions that present a thread-forming characteristic only when hot.

SUMMARY

The invention seeks to make it easier to apply such compositions, and more generally seeks to make it easier to apply any composition having some property on application that is modified by applying heat.

In one of its aspects, the invention provides a kit comprising:

an applicator device including a heater; and a composition for application to the eyelashes, said composition presenting at least one property that varies as a function of temperature, said composition being contained in an applicator endpiece of a shape that is adapted to being fitted to the heater, or being contained in a receptacle in the form of a powder in which the heater can be immersed so as to be loaded with composition.

The composition may be solid at ambient temperature and may soften, indeed become fluid, when heated.

By way of example, the composition is for lengthening the eyelashes, but it may also serve to make them up in some other way, in particular to curl them, depending on its formulation.

By way of example, the above-mentioned property is the thread-forming characteristic, the composition then presenting a thread-forming characteristic when it is heated above a certain temperature, e.g. 40° C.

The composition may present viscosity that decreases with increasing temperature.

The invention makes the composition easier to manipulate since it can suffice to dispose the applicator endpiece on the heater before proceeding with application to the eyelashes, and, when the applicator endpiece is no longer usable, said applicator endpiece can be replaced easily by a new applicator endpiece. Otherwise, it can suffice to dip the heater into the receptacle containing the composition, so as to load it with the composition.

The use of an applicator endpiece having a shape that is adapted to being fitted to the heater considerably simplifies putting the composition into place on the heater, compared to the devices disclosed in the publications WO 2006/057438 and WO 2006/057439, for example.

Fitting may be performed by inserting the heater into a cavity of the applicator endpiece.

In a variant, fitting may be performed by inserting the applicator endpiece into a cavity of the heater.

Fitting may be performed axially, along the longitudinal axis of the heater. In a variant, fitting may be performed sideways, in a transverse direction to the longitudinal axis of the heater. Fitting may also be performed in more complex manner, e.g. with turning or with snap-fastening. The term "fitting" should therefore be understood in a broad sense.

An applicator endpiece having a hollow shape may be preferred in some embodiments of the invention, since it enables said applicator endpiece, if so desired, to cover the heater easily over its entire circumference, thereby making it easier to use the applicator device in multiple orientations relative to the eyelashes.

The applicator endpiece can also have the shape of a stud, having a shank for fastening to the heater, and a head for applying to the eyelashes.

The applicator endpiece also need not cover the heater over its entire circumference, as happens when it presents a trough or dome shape, for example.

The heater may have a heating surface that extends over 360° about the longitudinal axis of the heater. In a variant, the heater may have a heating surface that extends over only a limited angular sector about the longitudinal axis of the heater.

When the applicator endpiece is trough shaped, the heating surface may extend angularly over about 180°. The heater may present a widening on either side of the heating surface, so as to delay and/or impede the flow of composition once the endpiece has been heated.

When the applicator endpiece does not extend all around the heater, for example has a shape of a trough (or tile), the heater may comprise at the opposite of the heated surface teeth, for example teeth molded with the heater.

The applicator endpiece may be made exclusively of the composition for application, in particular when said composition is solid at ambient temperature (25° C.). The composition may then be molded directly with the shape of the applicator endpiece, with a view to it being used subsequently by the consumer on the applicator device.

In a variant embodiment of the invention, the applicator endpiece is composite, and the composition is, for example, in the form of an outer coating on the surface of a substrate that is shaped for fitting to the heater. Such a composite structure may turn out to be desirable, e.g. for compositions that do not present rheology adapted to molding an applicator endpiece, or for improving the retention of the composition on the applicator endpiece when hot.

Depending on the shape given to the applicator endpiece, different makeup effects can be obtained.

In embodiments of the invention, the heater presents the shape of a finger. By way of example, the applicator endpiece may thus present the shape of a glove finger, e.g. being configured to come to cover the heater over at least a fraction of its length starting from its distal end.

An applicator endpiece in the shape of a glove finger makes it possible to use the distal end of the applicator endpiece for applying the composition to the eyelashes, thereby making localized treatment easier, e.g. eyelash by eyelash.

In at least one cross-section, the applicator endpiece may be continuous over its entire circumference. In a variant, the applicator endpiece presents an opening in at least one cross-section, the opening being, for example, a slot extending longitudinally along the applicator endpiece over at least a fraction of its length.

The applicator endpiece need not present any openings on its lateral surface.

The heater may comprise a sheath presenting a housing in which at least one heater resistor is disposed, the housing opening out at one end of the sheath, for example, so as to enable the heater resistor to be inserted into the sheath after the sheath has been manufactured. The housing may be central so as to make it possible, if so desired, to obtain a uniform temperature around the longitudinal axis of the heater.

In a variant, the heater comprises a sheath that is overmolded on the heater resistor.

The sheath may be made of a material that is a good conductor of heat, e.g. a metal or a thermoplastic or cross-linkable material filled with metal particles or having good thermal conductivity. The exterior surface of the heater may be defined are least partially, for example entirely, by a metal, a glass, a ceramic or an elastomer.

The applicator device may include at least one switch so as to enable the user to trigger heating of the heater. By way of example, the switch is a contactor, e.g. a pushbutton, that triggers heating of the heater when said pushbutton is depressed by the user, the heater ceasing to heat as soon as the contactor is released by the user. This enables the user to create pulses of heat that are relatively short and well mastered over time, thereby making it easier to apply the composition to the eyelashes.

In a variant embodiment of the invention, the applicator device includes a switch that is capable of taking up a position in which, even once released by the user, the heater remains powered, where appropriate, for a predefined period of time so as to economize the source of electricity.

The applicator device may include a regulator member for regulating the temperature of the heater.

The applicator device may also include an indicator light informing the user about the ON/OFF state of the heater and/or about the temperature of said heater, for example.

By way of example, the indicator light may be a lamp that lights up when the heater is electrically powered, and that changes color, flashes, or ceases to flash when the appropriate application temperature is reached.

The applicator device may also include a thermochromic indicator, e.g. changing color when an appropriate working temperature is reached.

The applicator device may include including a housing making it possible to receive at least one spare applicator endpiece prior to being fitted to the heater.

When the composition is contained in a receptacle so as to enable the heater to be loaded by dipping it into the receptacle, said receptacle can be independent of the applicator device in its closed state, or, in a variant it may be arranged so as to be fitted to the applicator device. By way of example, the applicator device may include a portion that is arranged to close the receptacle when not in use.

By way of example, the applicator device includes, on the side remote from the heater, a threaded skirt that is arranged to be screwed onto the receptacle. The receptacle may be provided with a gasket that bears against the applicator device when the heater is dipped into the receptacle, so as to reduce any risk of composition being lost during the loading operation.

The applicator device may include a casing housing a source of electricity, e.g. at least one optionally-rechargeable battery. The applicator device may also be powered by available power lines, e.g. by means of a step-down transformer. The use of a 9 V battery for powering the heater may increase the magnitude of the current in the resistor, and enable its temperature to rise more quickly, thereby making it easier to apply the make up.

By way of example, the source of electricity and the heater may be selected such that the heater can reach a surface temperature that is for example not greater than 95° C., for example lying in the range 45° C. to 95° C., for example lying in the range 45° C. to 90° C., better of at least 60° C., in less than 120 seconds (s), better in less than 30 s, starting from an initial temperature of 25° C. in a closed environment at 25° C.

The heater may present a shape that makes it easier to clean and/or to remove the applicator endpiece after use, in particular the heater may present a generally conical shape that converges towards its distal end. Such a shape may also be preferred when the heater is loaded by being dipped into the composition. The heater may be made of a material having a surface state and/or surface tension such that the composition does not adhere to the heater at 25° C. The surface of the heater may be smooth and non-porous or may comprise teeth, ridges and/or grooves.

The heater may be made of polytetrafluoroethylene (PTFE) (Teflon®), or it may include a coating of PTFE or of a similar material.

In an embodiment of the invention, the heater is stationary relative to a handle portion of the applicator device.

In another embodiment of the invention, the heater is movable relative to a handle portion of the applicator device.

By way of example, the heater is movable in translation. This makes it possible to make the applicator device more compact when not in use.

The applicator device may also be arranged such that the displacement of the heater relative to the handle portion causes the applicator endpiece to be ejected from the heater. To make such ejection easier, the applicator endpiece may, for example, include a thickening at its base, e.g. in the form of a collar, that comes to bear against a wall of the applicator device when the heater is displaced.

The heater may also be pivotable, e.g. about a pivot axis that is perpendicular to its longitudinal axis, about its own longitudinal axis, or about any axis that does not coincide with its longitudinal axis.

In a variant embodiment of the invention, the applicator device may also include an ejector member that is movable relative to the heater. By way of example, the ejector member is in the form of a pusher that is displaced by the user so as to drive the applicator endpiece out from the heater.

The heater may present any shape that is adapted to the desired makeup effect.

The heater may present a longitudinal axis that is optionally rectilinear. A curvilinear longitudinal axis may make it more ergonomic, for example.

The longitudinal axis of the heater may coincide with or be parallel to the longitudinal axis of a handle portion of the applicator device, the handle portion coinciding with a casing of the applicator device, for example.

The longitudinal axis of the heater may also be rectilinear and form an angle with the longitudinal axis of the handle portion of the applicator device.

The heater may present a cross-section that decreases towards its distal end. This can make it easier to remove the applicator endpiece.

The support may include a heater resistor disposed inside a sheath that may present a thickness that is substantially constant, e.g. so as to make it easier to obtain a temperature that is relatively uniform over the entire length of the heater. Where appropriate, the sheath may present wall thickness that varies longitudinally as a function of a desired temperature profile.

By way of example, the thickness of the sheath may decrease towards the distal end of the heater, e.g. so as to obtain a higher temperature at the end of the heater. In a variant, the thickness of the sheath may be constant over at least the portion covered by the composition.

The heater may present an outside surface of shape that is optionally circular in cross-section, e.g. polygonal, and it may optionally be smooth, or may optionally present ridges, or any other portion in relief.

The presence of portions in relief such as ridges, in particular longitudinal ridges, may, for example, encourage the composition to adhere once it has been softened or become liquid by the heat given off by the heater.

The applicator endpiece may present an inside cross-section that is optionally geometrically similar to the outside cross-section of the heater.

The applicator endpiece may present a shape that tapers, and, in particular, may include a narrow tip, thereby making it easier to treat the eyelashes one by one.

The applicator endpiece may present an outside surface of shape that is generally conical over at least a fraction of its length.

The distal end of the applicator endpiece may be rounded.

The applicator endpiece may present a thickening at its base, e.g. in the form of a collar, making it easier for the user to hold the applicator endpiece and/or to remove the applicator endpiece from the heater. The thickening may cover a region of the applicator device that is not heated.

The applicator endpiece may present an outside cross-section of shape that is optionally circular, e.g. polygonal, and/or flat, optionally with ridges.

The applicator endpiece may present axial symmetry, indeed it may be a body of revolution.

Over at least a fraction of its length, the applicator endpiece may present wall thickness that is substantially constant, e.g. lying in the range 0.5 millimeters (mm) to 2 mm.

The applicator device need not have an applicator element such as teeth or bristles, in particular when it is for depositing a composition that makes it possible to extend the eyelashes.

In a variant, the applicator device may include bristles and/or at least one row of teeth, e.g. so as to comb the eyelashes after applying the composition, in particular when said composition is not for extending the eyelashes.

The teeth and/or bristles may be secured to the heater and/or in a variant may be secured to a holder member that is disposed in the proximity of the heater, e.g. extending along at least one side of said heater or along two opposite sides of the heater.

Where appropriate, the applicator device includes a presser element for curling the eyelashes after applying the composition.

By way of example, the kit may include a thread cutter that is secured to the applicator device. By way of example, the thread cutter may comprise a blade that is integrally molded with the casing of the applicator device. The thread cutter may also be secured to a cap for covering the heater.

In another of its aspects, the invention also provides an applicator endpiece that is made, at least in part, or even entirely out of a composition for making up the eyelashes and having a property that varies as a function of temperature, in particular a thread-forming characteristic that varies as a function of temperature.

By way of example, the composition may be solid at 25° C. and may present a thread-forming characteristic at 45° C.

By way of example, the applicator endpiece presents the shape of a stud or a shape presenting a concave face, e.g. a hollow shape, e.g. the shape of a glove finger, a trough, or a dome, as mentioned above.

In another of its aspects, and independently or in combination with the above, the invention also provides an applicator endpiece that is made, at least in part, or even entirely out of a composition for making up the eyelashes and having a property that varies as a function of temperature, which property may optionally be the thread-forming characteristic. The applicator endpiece may have the shape of a stud or a shape presenting a concave face, e.g. a hollow shape, preferably the shape of a glove finger, a trough, or a dome.

The applicator endpiece may be proposed to the user within a string of endpieces made as a single part by molding the composition, two adjacent endpieces being connected together by at least one breakable bridge of material.

The applicator endpiece may have a shape that enables it to be stacked.

A plurality of endpieces may also be proposed to the user secured to a grid from which each endpiece can be extracted by the heater, e.g. by means of a friction force between the heater and the endpiece that is greater than the holding force holding the endpiece on the grid.

In another of its aspects, the invention also provides an applicator device for applying a composition to the eyelashes, said device including a heater for loading with a composition for applying to the eyelashes and having a property that varies as a function of temperature, in particular a thread-forming characteristic that varies as a function of temperature.

The applicator device may be arranged in such a manner that, while the heater is operating, the temperature of the heater lies in the range 45° C. to 90° C., better in the range 50° C. to 70° C., over at least a fraction of its length, and all around the longitudinal axis of said fraction.

The device may include regulator means for regulating the temperature of the heater, e.g. a thermostat or an electronic circuit including a temperature sensor.

The heater may be movable relative to a casing of the applicator device, or the applicator device may include an ejector member for ejecting the applicator endpiece, as mentioned above.

The heater may present a heating surface of shape that tapers, in particular conical shaped, or that is convex, in particular semicylindrical, spherical, or dome shaped.

The heater may present the shape of a finger, in particular a shape that tapers, so as to make it easier to extract the applicator endpiece after use.

The heater may include a central housing containing a heater resistor.

The invention also provides the applicator device comprising the heater, as such, regardless of the kind of composition applied to the eyelashes, which composition may optionally present a thread-forming characteristic. The device may include or be arranged to receive a source of vibration.

The invention also provides a method of making up the eyelashes, the method comprising the steps consisting in:

fitting an applicator endpiece to an applicator device including a heater, the applicator endpiece preferably having the shape of a stud or a shape presenting a concave face, e.g. a hollow shape that is open at least one end so as to enable the endpiece to be put into place on the heater, in particular the shape of a glove finger, a trough, or a dome, and said applicator endpiece comprising a composition for making up the eyelashes and that presents a property that varies as a function of temperature, in particular a thread-forming characteristic that varies as a function of temperature, the applicator endpiece having a shape that is adapted to being fitted to the heater; or loading a heater of an applicator device with a composition for making up the eyelashes by immersing the heater in the composition, the composition presenting a property that varies as a function of temperature, in particular a thread-forming characteristic that varies as a function of temperature; then with the heater in its hot state, and while thus coated in composition, bringing it into contact with the eyelashes, so as to deposit the composition on the eyelashes, and, in particular, so as to extend the eyelashes.

In an implementation of the method, with the applicator endpiece and the heater both presenting a generally elongate shape, the composition is deposited on the eyelashes with the longitudinal axis of the heater being oriented substantially perpendicularly to the eyelashes.

The composition in which the heater is immersed may be a powder.

In another implementation of the method, the composition is deposited on the eyelashes with the longitudinal axis of the heater being oriented substantially perpendicular to the row of eyelashes.

In an embodiment of the invention, the composition is present at the distal end of the heater, and the treatment is performed eyelash by eyelash.

The composition may be deposited on eyelashes that are already coated in a base coat, e.g. eyelashes that are already made up.

In particular, the composition may be deposited at the ends of the eyelashes.

The method may include the step consisting in cutting to a desired length the threads of composition that are formed extending the eyelashes.

The heater may be brought into contact with the eyelashes while it is being subjected to vibration.

In another of its aspects, and independently or in combination with the above, the invention also provides, a kit comprising:

an applicator device including a heater; and an applicator endpiece having a shape that is adapted to being fitted to the heater, e.g. having the shape of a stud or having a hollow shape, in particular the shape of a glove finger, a trough, or a dome, and said applicator endpiece comprising a composition that presents a thread-forming characteristic when it is heated above a certain temperature, e.g. 45° C.

BRIEF DESCRIPTION OF THE DRAWINGS

The invention can be better understood on reading the following detailed description of non-limiting embodiments thereof, and on examining the accompanying drawings, in which.

MORE DETAILED DESCRIPTION

Figure 1:
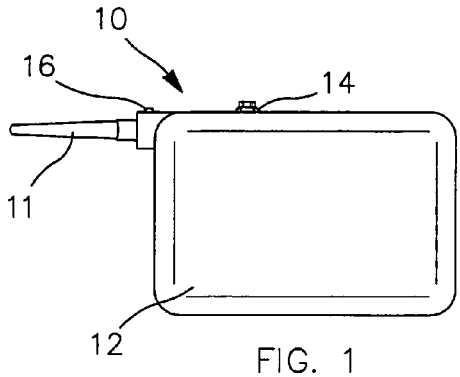
FIG. 1 is an elevation view of an example of an applicator device constituting an embodiment of the invention.

The applicator device 10 shown in FIGS. 1 to 4 comprises a heater 11 and a casing 12 housing a source of electricity 13, which, as shown, is constituted by a flat 9 volt (V) battery, for example.

In a variant not shown, the source of electricity is rechargeable and can be recharged by placing the applicator device on a stand, for example.

In another variant not shown, the 9V battery is replaced by at least one 1.5 V round battery, or even two 1.5 V batteries disposed side by side, or a 3 V button battery.

The applicator device can also use a storage battery, or it can be powered by the mains.

Figure 13:
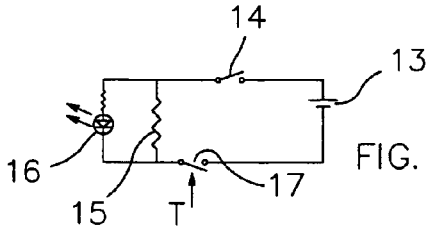
FIG. 13 is an example of a circuit diagram of the applicator device.

The applicator device 10 can include a control member 14 for controlling the operation of the heater 11, said control member being, for example, in the form of a contactor, e.g. a pushbutton, that, when depressed by the user, makes it possible to deliver electrical power to a heater resistor 15, not visible in FIG. 1, but visible in the circuit diagram in FIG. 13.

As shown, the applicator device 10 can possibly include a pilot lamp 16 for informing the user that the heater resistor 15 is switched on.

The heater resistor 15 can be selected such that even when electrically powered with direct current (DC), the temperature at the surface of the heater 11, in an environment close to 25° C., remains lower than a temperature that might lead to a risk of the user being burnt in the event of accidental contact, e.g. a temperature of 90° C. or 95° C.

In a variant, e.g. in order to have better control over the temperature of the heater 11, the applicator device 10 can include a regulator member 17 for regulating its temperature, e.g. in the form of a bimetallic thermostat or of an electronic regulator circuit including a temperature sensor integrated in the heater 11, for example.

In operation, the surface temperature of the heater 11 preferably remains in the range 45° C. to 95° C., better 45° C. to 90° C., better yet, in the range 55° C. to 65° C., but it is not beyond the ambit of the present invention for the operating temperature to be different, in particular higher.

The surface temperature preferably varies by less than 5° C. around the circumference of the heater at any point along its length.

Figure 2:
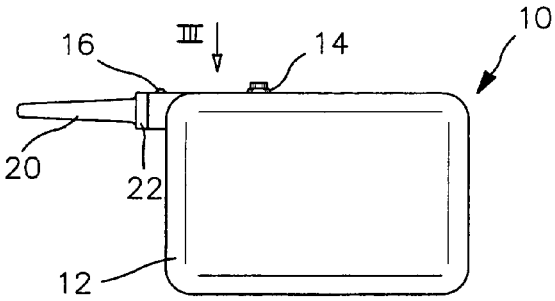
FIG. 2 is a view similar to FIG. 1, an applicator endpiece being disposed on the heater of the applicator device.
Figure 3:
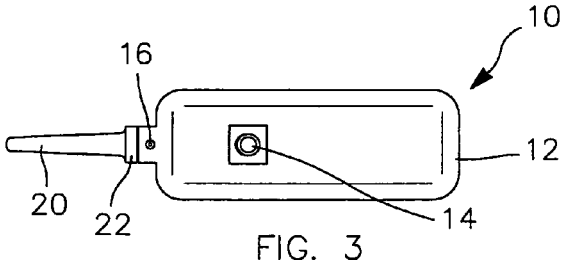
FIG. 3 is a plan view as seen looking along III of FIG. 2.
Figure 4:
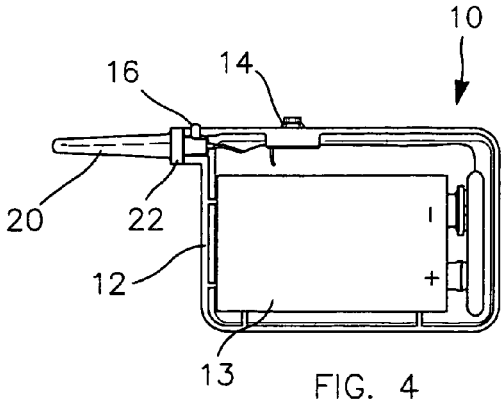
FIG. 4 is a diagram showing the FIG. 2 kit with part of the casing of the applicator device being shown in section.

In an embodiment of the invention, the heater 11 can receive an applicator endpiece 20, as shown in FIGS. 2 to 4.

The applicator endpiece 20 comprises a composition for making up the eyelashes that presents a property that varies as a function of temperature, in particular a thread-forming characteristic.

By way of example, the composition comprises at least one reversible polymer.

In particular, the thread-forming characteristic can present $d_{max}$ greater than or equal to 5 mm, measured as mentioned below.

The thread-forming characteristic of a composition can be determined by means of a texture meter sold under the trade name TA X-T2i from the supplier RHEO and equipped with a movable body that is temperature controlled, the body being a stainless steel cartridge heater referenced Firerod DIV-STL (Watlow France) having a diameter of 3.17 mm and a length of 60 mm, and having a maximum power of 40 watts (W) at a voltage of 24 V, and including a C lock type K thermocouple.

The cartridge heater is powered by a DC source, and its temperature is regulated by a PID TC 48 controller from the supplier Faucigny Instrument (France). A fastener appendage was created for fastening the temperature-controlled body onto the measuring arm of the texture meter.

Measurement is performed on threads of composition that are obtained by causing the body to be displaced vertically until making contact with a sample of the composition, and then, after remaining in contact for a period of time, by causing the body to be displaced vertically upwards. With a composition that has a thread-forming characteristic when hot, a thread forms between the sample of composition and the body moving away from it, the thread becoming stiffer under the effect of cooling in ambient air. Measuring $d_{max}$ consists in measuring the length of the threads that are formed in this way after being detached from the surface of the body.

The protocol used was as follows:

a) preparing a sample of the composition by completely filling a stainless steel dish having a thickness of 2 mm and a diameter of 20 mm, with any excess composition being removed by leveling the surface;

b) setting the temperature of the body at 40° C.;

c) lowering the body at a speed of 10 millimeters per second (mm/s) until making contact with the surface of the composition; and d) holding the body stationary for 10 s, and then raising it at a speed of 10 mm/s.

While the body is moving away, a thread forms between the composition and the body. As the body moves away from the surface of the composition, the thread being formed cools and becomes stiffer. After being pulled to a certain length, the thread becomes detached from the body.

The magnitude $d_{max}$ (expressed in mm) corresponds to the length of the thread obtained after rupture, as measured with a graduated ruler.

The thread-forming characteristic is measured three times for the same composition, at different locations in the dish, and an average $d_{max}$ for the thread-forming characteristic is calculated for each composition.

Steps b) to d) are repeated for the same composition at a body temperature that is set in step b) at 50° C., 60° C., 70° C., 80° C., 90° C., 100° C., 110° C., 120° C., 130° C., or 140° C., respectively.

Amongst the various thread-forming values obtained at the various temperatures, the highest valve is retained as the value $d_{max}$ for the thread-forming characteristic.

By way of example, the composition used can present a thread-forming characteristic $d_{max}$ that is greater than or equal to 5 mm, possibly going up to 100 mm, preferably greater than or equal to 7 mm, better greater than or equal to 10 mm, and better greater than or equal to 15 mm.

Preferably, the composition should be capable of forming a thread such that, once the thread has been formed and $d_{max}$ has been measured using the protocol specified above, if the dish containing the composition is placed vertically (in such a manner that the thread is in a horizontal position, i.e. subjected to gravity) for at least thirty seconds, the thread maintains a minimum length of 5 mm (measurable manually with the graduated ruler).

By way of example, the temperature to which the applicator endpiece 20 is brought is the temperature at which the value $d_{max}$ for the thread-forming characteristic is at its maximum.

The composition can include fibers.

The composition can present thermoplastic behavior.

The composition can include at least one compound selected from:

- polymers and copolymers including at least one alkene monomer, in particular ethylene-based copolymers;
- polyvinyl acetate homopolymers;
- silicone resins;
- sequenced ethylene polymers that are film-forming and that preferably include at least a first sequence and at least a second sequence having different glass temperatures (Tg), said first and second sequences being connected together by an intermediate sequence that includes at least one component monomer of the second sequence;
- diene and styrene copolymers;
- sulfopolyesters;
- waxes;
- fibers;

and mixtures thereof;

- alkene and vinyl acetate copolymers, in particular ethylene and vinyl acetate copolymers;
- ethylene and octene copolymers;
- polyvinyl acetate homopolymers;
- silicone T-resins, such as polyphenylsiloxanes;
- sequenced ethylene copolymers that are film-forming and that are obtained essentially from monomers selected from alkyl methacrylates, alkyl acrylates, and mixtures thereof;
- butadiene and styrene copolymers;
- copolymers obtained by condensing diethylene glycol, dimethanol cyclohexane, isophthalic acid, sulfoisophthalic acid;
- and mixtures thereof.

Figures 28, 29, 30, 31, 32, 32A, 32B, 32C, 33, 34, 35, 36, 39, 40, 41, 42, 43, 44, 45, 46, 47, 48, 49:
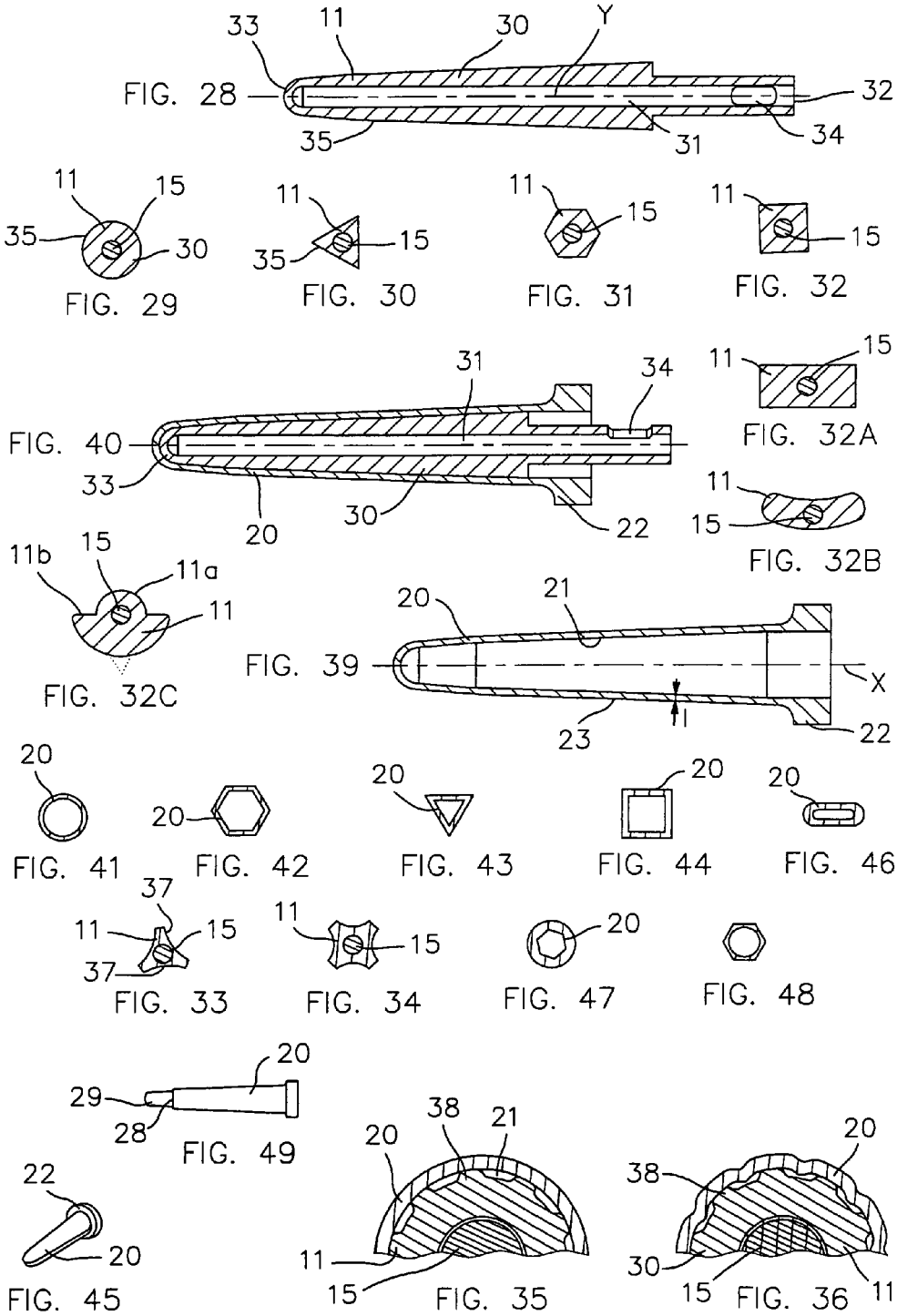
FIG. 28 shows an embodiment of the casing of the heater in isolation.
FIGS. 29 to 34 are cross-section views of various embodiments of the heater.
FIG. 35 is a cross-section view of a variant embodiment of the heater, provided with an applicator endpiece.
FIG. 36 shows the deformation of the applicator endpiece under the effect of the heat given off by the FIG. 35 heater.
FIG. 39 is a longitudinal section showing an applicator endpiece in isolation.
FIG. 40 shows the FIG. 39 applicator endpiece fitted to the sheath of the FIG. 28 heater.
FIGS. 41 to 44 and 46 to 48 are views showing examples of cross-sections of the applicator endpiece, amongst others.

The heater 11 can be made in various ways, and can, for example, comprise a sheath 30 defining a housing 31 for receiving the heater resistor 15 and being open at one end 32, the distal end 33 of the sheath 30 presenting a rounded shape, as shown in FIG. 28.

The housing 31 is preferably central.

The outside surface of the sheath 30 can taper by about 3° to 5°, for example.

By way of example, the thickness of the sheath 30 lies in the range 0.3 mm to 1.5 mm, and is preferably constant in the circumferential direction around the heater resistor.

By way of example, the housing 31 is cylindrical in shape, having a diameter of about 1.2 mm, for example.

By way of example, the heater resistor 15 presents a diameter of 1 mm.

By way of example, the length of the heater 11 lies in the range 2 mm to 40 mm, being about 30 mm, for example.

Where appropriate, the sheath 30 can include a side opening 34 for fastening said sheath on the casing 12.

By way of example, the sheath 30 is made of metal, in particular of aluminum or any other metal or alloy that is a good conductor of heat.

The sheath 30 can also be made of a filled synthetic material, e.g. a thermoplastic or cross-linked material including a filler of particles, in particular of aluminum, of copper, or of magnesia.

The applicator endpiece 20 can present the general shape of a glove finger, e.g. being a body of revolution about a longitudinal axis X.

The inside surface 21 of the applicator endpiece 20 can match the shape of the outside surface 35 of the sheath 30, as shown in FIG. 40, with tapering making it easier to evacuate any composition remaining on the heater 11 after application.

At its base, the applicator endpiece 20 can include a thick collar 22, the thickness of the collar 22 being at least twice the thickness of the endpiece half-way along its length, for example.

On being fitted to the heater 11 while cold, the applicator endpiece 20 is held on the heater 11 by friction, for example.

The thickness e of the applicator endpiece 20 from the collar 22 to the distal end, lies in the range 0.2 mm to 2 mm, for example, and preferably in the range 0.3 mm to 1 mm, e.g. being about 0.4 mm.

The collar 22 can present a thickness that is greater than e, in particular greater than 1 mm, e.g. about 2 mm.

The applicator endpiece 20 can cover a region of the applicator device 10 that is not heated.

For example, the collar 22 can cover a region of the applicator device that is not heated, e.g. a ring made of a thermally insulating material and situated at the base of the heater 11.

Figure 6:
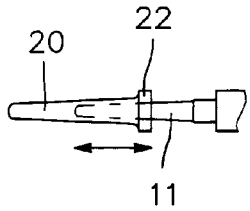
FIG. 6 shows the applicator endpiece being removed.

The applicator endpiece can be fitted by mutual engagement by displacing said applicator endpiece along the longitudinal axis of the heater 11, as shown in FIG. 6. Removal can be performed by the opposite movement.

Figure 7:
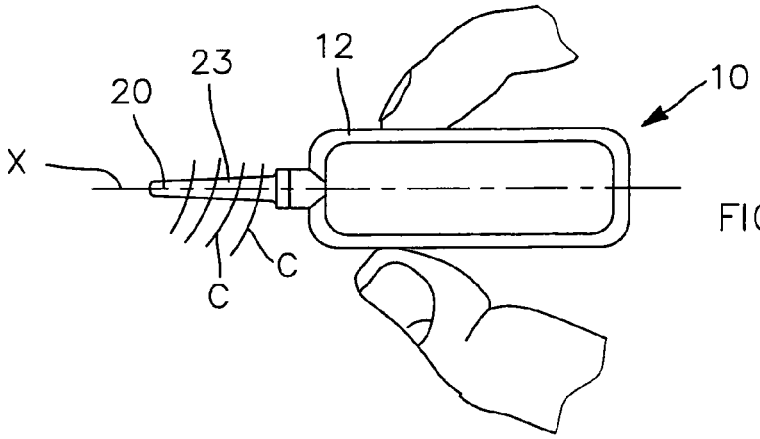
FIGS. 7 to 10 show the FIG. 2 kit in use for making up the eyelashes.
Figure 8:
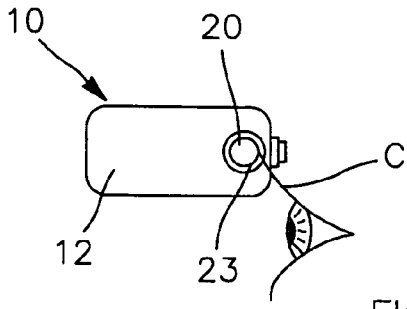

By way of example, the composition can be applied to the eyelashes C by bringing the lateral outside surface 23 of the heated applicator endpiece 20 tangentially into contact with the eyelashes C, as shown in FIGS. 7 and 8. By way of example, the longitudinal axis X of the applicator endpiece 20 is oriented substantially parallel to the row of eyelashes.

During application and by way of example, the applicator endpiece 20 is displaced sideways, parallel to itself and substantially without turning, along the eyelashes C, from their base to their tips and beyond said tips, so as to create threads of composition extending the eyelashes.

The user can possibly act on the heater-control member 14, so as to act on the consistency of the composition and obtain the desired result.

The composition can be applied to a plurality of eyelashes-C simultaneously.

Figure 9:
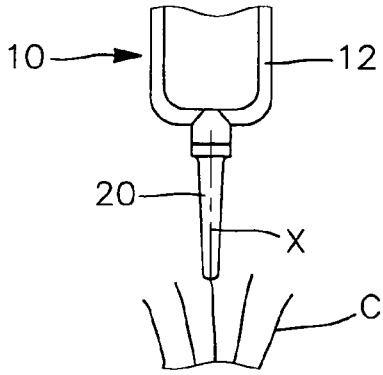
Figure 10:
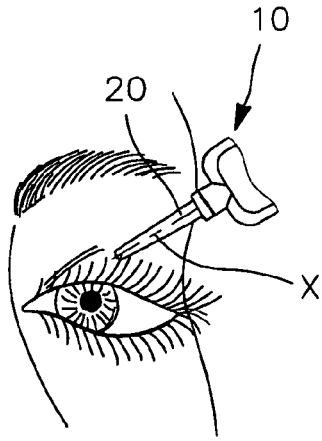

In a variant, the user can treat the eyelashes individually, as shown in FIGS. 9 and 10, e.g. by bringing the distal portion of the applicator endpiece 20 into contact with one eyelash C, the axis X being oriented substantially perpendicularly to the row of eyelashes, for example.

The threads of composition can be cut to the desired length after being formed at the ends of the eyelashes.

Figure 11:
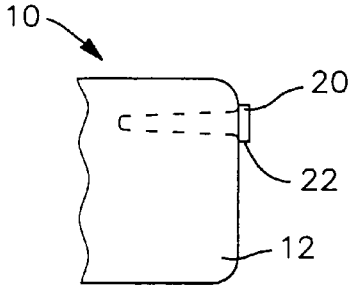
FIG. 11 shows a spare applicator endpiece fitted in a variant of the FIG. 1 applicator device.

The applicator device 10 can be made with a housing for receiving a spare applicator endpiece, as shown in FIG. 11.

By way of example, the housing is provided in the casing 12 on the side remote from the heater 11, e.g. being arranged so as to leave the collar 22 of the applicator outside the casing 12, where the user can take hold of it easily.

Figure 12:
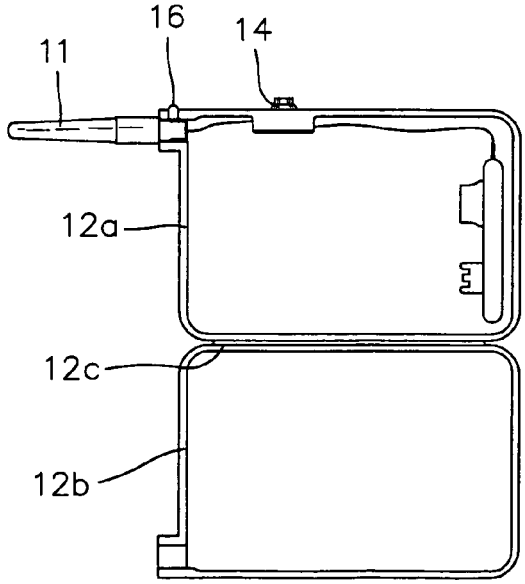
FIG. 12 shows the casing of the FIG. 1 applicator device made as two portions that are integrally molded as a single part.

In a variant, the casing 12 includes a housing that is accessible by opening a flap of the casing, and that is for receiving one or more applicator endpieces 20. Where appropriate, the housing can be accessed by opening the casing, in particular when said casing is made by molding, with two portions 12*a* and 12*b* being connected together via a film hinge 12*c*, as shown in FIG. 12.

Figure 14:
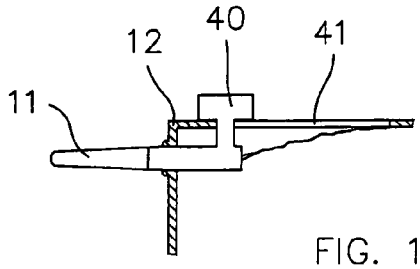
FIGS. 14 and 15 are fragmentary and diagrammatic views of a variant embodiment in which the heater is movable relative to the casing of the applicator device.
Figure 15:
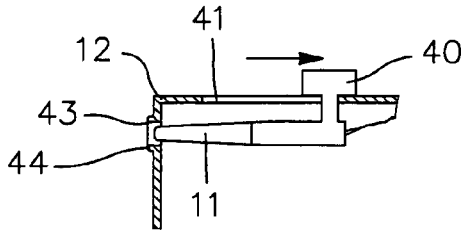

The heater 11 can be stationary relative to the casing 12. In a variant, as shown in FIGS. 14 and 15, the heater 11 can be movable relative to the casing 12, e.g. between a working position, shown in FIG. 14, and a retracted position, shown in FIG. 15.

By way of example, the heater 11 can be displaced by means of a slider 40 that is movable relative to the casing 12 and that is secured to the heater 11.

By way of example, the slider 40 can slide in a slot 41 of the casing 12.

The heater 11 can be moved regardless of whether or not it is electrically powered. In a variant, electrical power can be supplied to the heater 11 only when it is in its extended position, and regardless of how the applicator device is made.

As shown in FIGS. 14 and 15, the heater 11 can be moved through an opening 43 in the casing 12, which opening preferably presents a size that is sufficiently small for retraction of the heater 11 to be accompanied by ejection of the applicator endpiece 20 that remains bearing against the surface 44 of the casing 12, around the opening 43.

Where appropriate, locking means can be provided for locking the heater 11 in its retracted or extended positions, the locking means being in the form of a portion in relief, for example, generating a hard point in the moving stroke of the heater 11.

Figure 16:
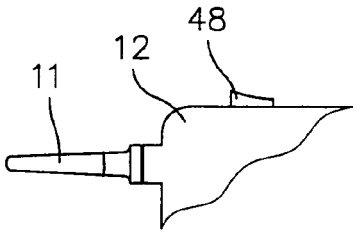
FIGS. 16 and 17 are fragmentary and diagrammatic views of a variant embodiment including a pusher for ejecting the applicator endpiece.
Figure 17:
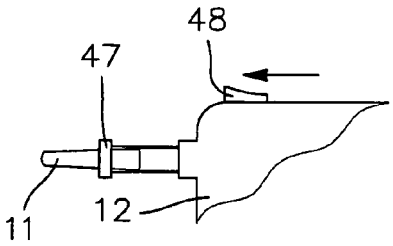

In the variant shown in FIGS. 16 and 17, the applicator endpiece 20 is ejected by means of an ejector pusher 47 that can be moved relative to the heater 11 when the user presses on an actuator member 48.

Figure 18:
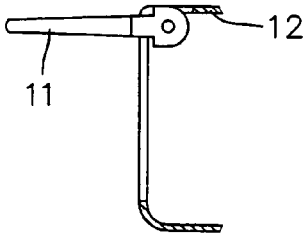
FIGS. 18 and 19 are diagrams showing a variant embodiment in which the heater is hinged relative to the casing of the applicator device.
Figure 19:
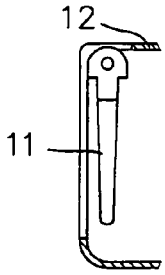

The heater 11 can also be movable relative to the casing of the applicator device 10 other than in translation, e.g. by turning about its longitudinal axis or by pivoting about an axis that is perpendicular thereto, as shown in FIGS. 18 and 19.

In this embodiment, the heater is movable through about one fourth of a turn between an extended position, shown in FIG. 18, and a retracted position shown in FIG. 19. Such pivoting can be useful, in particular for making the applicator device more compact when not in use.

Where appropriate, passing from the extended position to the retracted position can be performed against the return action of a spring member, and the applicator device can include an unlocking member for unlocking the heater 11 so that said heater can return automatically to the extended position under the return action of the spring member.

Figure 20:
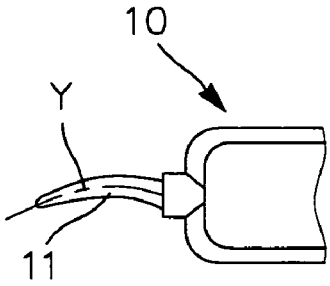
FIGS. 20 and 21 show variant embodiments of the heater.

The heater 11 can be made in various shapes and with various orientations. The embodiment in FIG. 20 shows the possibility of the heater 11 extending along a curvilinear longitudinal axis Y, the axis Y being substantially in the shape of an arc of a circle, for example, of curvature that matches the curvature of a row of eyelashes, for example.

Figure 21:
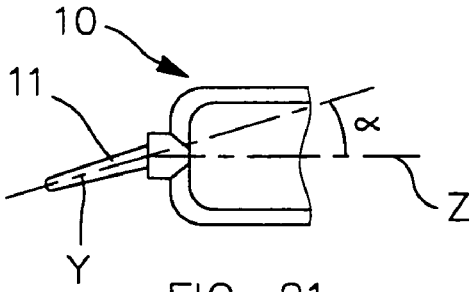
Figure 22:
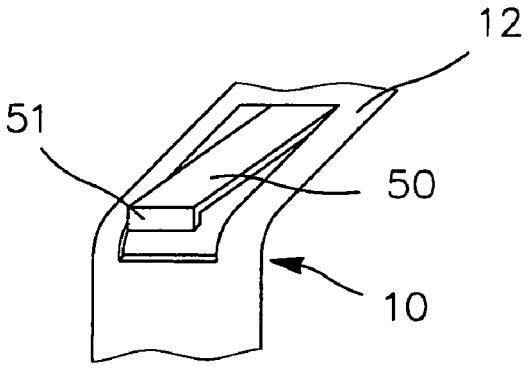
FIG. 22 is a diagram showing a thread cutter.

In the variant shown in FIG. 21, the longitudinal axis Y of the heater 11 is rectilinear, and it extends at an angle $\alpha$ with the longitudinal axis Z of the casing 12 of the applicator device.

Where appropriate, the eyelash treatment kit comprising the applicator device 10 and the applicator endpiece 20 can also include in a same packaging a thread cutter 50, as shown in FIG. 22.

By way of example, the thread cutter 50 forms part of the applicator device 10, as shown in this figure, e.g. being made at least in part, or even entirely as a single part with the casing 12 by molding a plastics material, or being fitted to said casing. In a variant not shown, the thread cutter can also be made with a removable cap for protecting the heater.

In a variant, the thread cutter 50 can also be independent of the applicator device 10, and can, for example, be provided to the user in a common packaging, or with the applicator endpieces 20, or with a receptacle containing the composition.

Figure 23:
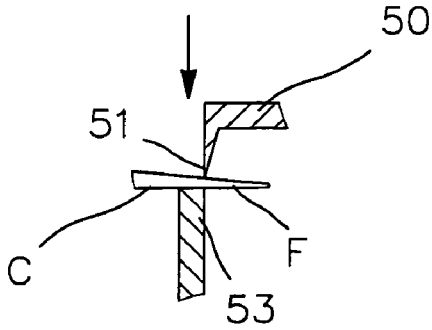
FIG. 23 shows the FIG. 22 device in use.

The thread cutter 50 shown in FIG. 22 presents a blade 51 for cutting a thread F of composition extending the end of an eyelash C, as shown in FIG. 23, to the desired length. The thread F can be cut by being pinched between the blade 51 and a backing blade 53 that is formed by a wall of the casing 12, for example.

The thread cutter 50 could also be in some other form, in particular in the form of a guillotine.

Figure 24:
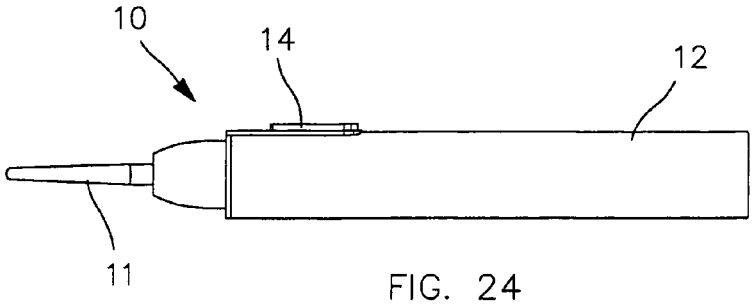
FIG. 24 is a side view showing a variant embodiment of the applicator device.
Figure 25:
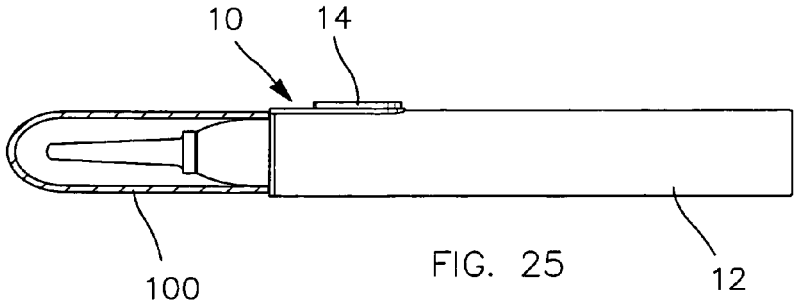
FIG. 25 is a view similar to FIG. 24, after fitting an applicator endpiece to the heater.
Figure 27:
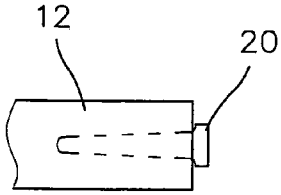
FIG. 27 shows a spare applicator endpiece fitted in an applicator device similar to the applicator device in FIG. 24.
Figure 5:
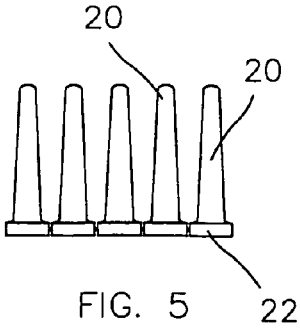
FIG. 5 shows a string of applicator endpieces.
Figure 26:
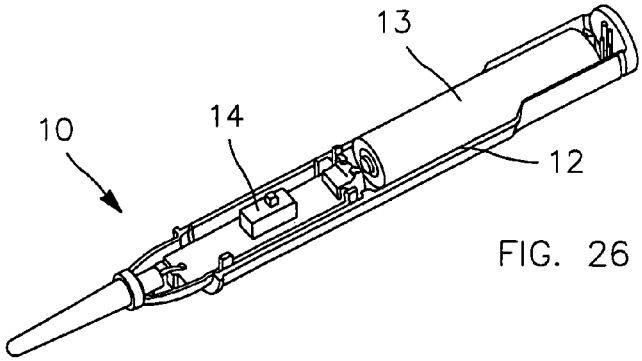
FIG. 26 shows the FIG. 25 kit with the casing partially removed.

The casing 12 can be made with various shapes, and, as shown in FIGS. 24 to 26, it can be made with an elongate tubular shape that gives the applicator device 10 the general shape of a pen.

Where appropriate, at its end remote from the heater 11, such an applicator device 10 can include a housing for receiving a spare applicator endpiece, as shown in FIG. 27.

By way of example, a pen shape makes it possible to use one or more 1.5 V round batteries for the source of electricity 13.

FIG. 25 shows the possibility of the applicator device 10 including a cap 100 that is suitable for covering the heater 11 before and after applying the composition. Where appropriate, such a cap 100 can make it easier to raise the temperature of the applicator endpiece 20 because of the confinement of the hot air. It is also possible to provide the applicator device 10 shown in FIG. 1, or any other applicator device 10, with a cap 100.

The heater 11 can be made with various shapes, and in particular with various cross-sections, in particular for the portion that is covered by the applicator endpiece 20 during use. This portion is of length lying in the range 3 mm to 40 mm, for example.

By way of example, various possibilities for cross-sections are shown in FIGS. 29 to 34.

The heater 11 can present a sheath 30 having an outside surface of section that is circular, as shown in FIG. 29, or polygonal, e.g. triangular, as shown in FIG. 30, hexagonal, as shown in FIG. 31, or square, as shown in FIG. 32, with, where appropriate, concave faces 37, as shown in FIG. 33 or 34, or else, in variants not shown, with lobes, or polygonal having more than six sides, e.g. octagonal.

Where appropriate, the outside surface of the sheath 30 can be made with portions in relief such as ridges 38, as shown in FIGS. 35 and 36. By way of example, the ridges extend longitudinally over at least the major fraction of the length of the portion for being covered by the applicator endpiece 20.

FIG. 32A shows a heater having a rectangular-shaped section, and FIG. 32B shows a heater having a kidney-shaped cross-section.

The heater shown in FIG. 32C presents a top portion 11*a* and a base 11*b* that projects beyond either side of the top portion 11*a*.

Figure 61:
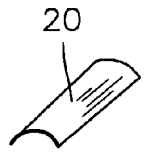
FIG. 61 shows a variant applicator endpiece in the shape of a trough.

By way of example, the top portion 11*a* presents a semi-cylindrical shape. The width of the base 11*b* on either side of the top portion 11*a* is greater than or equal to the thickness of the associated applicator endpiece, for example. As shown in FIG. 61, the associated applicator endpiece can present a trough shape (upside-down), of dimensions adapted to the dimensions of the top portion 11*a*.

Figure 62:
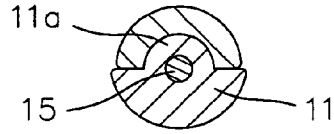
FIG. 62 shows the FIG. 61 endpiece fitted to the FIG. 32C heater.

When the applicator endpiece is fitted sideways onto the top portion 11*a*, as shown in FIG. 62, the applicator endpiece 20 can come into contact with, or into the proximity of, the base 11*b* which can impede the composition from flowing downwards.

The base 11*b* of the heater can be made of an optionally heat-conductive material. Making the base 11*b* out of a thermally insulating material can improve its function of retaining the composition.

The base 11*b* may comprise, in a variant, at least one row of teeth at the opposite from the heated surface. This row is shown in dotted lines on FIG. 32C.

The applicator endpiece 20 can present an inside surface 21 that does not entirely match the shape of the facing outside surface of the heater 11, as in the embodiment in FIG. 35, the applicator endpiece 20 initially coming into contact with the heater 11 only via the ridges 38, for example.

While the heater 11 is being heated, the applicator endpiece 20 softens, indeed becomes fluid, and the applicator endpiece 20 can deform and tends to take on the shape of the outside surface of the heater, as shown in FIG. 36.

This can improve the retention, in particular by capillarity, of the composition of the applicator endpiece 20 on the heater, and can reduce any risk of the composition flowing away from the heater 11.

Figure 37:
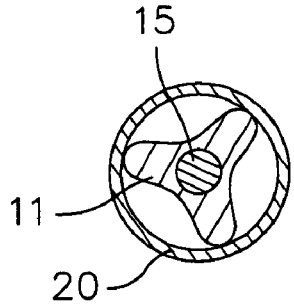
FIGS. 37 and 38 are views similar to FIGS. 35 and 36, with another shape of heater.
Figure 38:
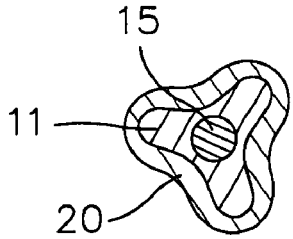

In the embodiment in FIGS. 37 and 38, the heater 11 presents a multi-lobed shape, e.g. triple lobed as shown, and the applicator endpiece 20 initially does not come into contact with the bottoms of the concave surfaces defined between the lobes.

It is only after the applicator endpiece 20 has softened, as shown in FIG. 38, that the composition comes into contact with the heater 11 over its entire circumference.

The applicator endpiece 20 can be made with various shapes that are adapted to the shape of the heater 11 and to the desired makeup effect.

In particular, in its portion that is for contacting the eyelashes, the applicator endpiece 20 can present a cross-section that is circular, as shown in FIG. 41, or non-circular, e.g. polygonal, in particular hexagonal, as shown in FIG. 42, triangular, as shown in FIG. 43, square, as shown in FIG. 44, or even rectangular or octagonal.

The applicator endpiece 20 can also be made with a flat shape, e.g. at least in its distal portion, as shown in FIGS. 45 and 46.

The applicator endpiece 20 can be made with a thickness of material that is constant, in particular in its portion for coming into contact with the eyelashes, e.g. the portion of the applicator endpiece covering the side surface of the heater 11.

Alternatively, the thickness of material need not be constant, e.g. because of the fact that the outer and inner contours of the applicator endpiece 20 present different shapes in cross-section, e.g. a circular shape for the outer contour and a polygonal shape for the inner contour, as shown in FIG. 47, or vice versa, as shown in FIG. 48.

The applicator endpiece 20 can be made with a narrow tip 29 at its end, as shown in FIG. 49, the narrow tip 29 being connected via a step 28 to the remainder of the applicator endpiece 20.

The narrow tip 29 need not overlie the heater 11.

In a variant, said heater can be made with a narrow shape that corresponds to the shape of the tip 29 of the applicator endpiece.

The presence of a narrow portion at the distal end of the applicator endpiece 20 makes it easier to treat eyelashes one by one.

Figure 50:
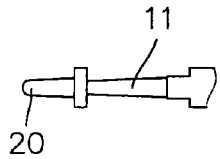
FIG. 45 and FIGS. 49 to 51 show variant embodiments of the applicator endpiece.

The applicator endpiece 20 can have a length that corresponds substantially to the length of the heater, e.g. a length that is a little longer so that the applicator endpiece presents a non-heated portion that substantially maintains its shape, and makes it easier to extract what remains of the applicator endpiece after use. In a variant, the applicator endpiece 20 can present a length that is shorter than the length of the heater, as shown in FIG. 50.

Where appropriate, a plurality of applicator endpieces having different shapes and/or made of different compositions can be proposed with a single applicator device, the user selecting the endpiece adapted to the makeup effect to be achieved.

The applicator endpiece 20 preferably presents a hollow shape and comes to cover the side surface of the heater 11, but the invention is not limited to such an arrangement of the applicator endpiece 20 relative to the heater 11.

Figure 51:
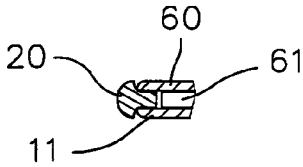

By way of example, the applicator endpiece 20 can present the shape of a stud, and can be fitted in a housing 60 provided at the end of the heater 11, as shown in FIG. 51.

In such an embodiment, the applicator endpiece 20 is covered in part by the heater.

Where appropriate, an inner pusher 61 is provided so as to eject the endpiece after use, the pusher 61 sliding inside a housing of the heater 11, for example.

The head of the endpiece that covers the end of the heater can be used to make up the eyelashes.

Figure 63:
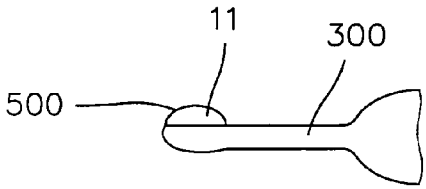
FIG. 63 shows a variant embodiment of the heater.
Figure 64:
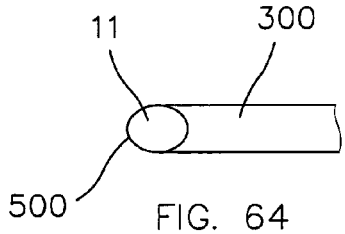
FIG. 64 shows the FIG. 63 heater in plan view.
Figure 65:
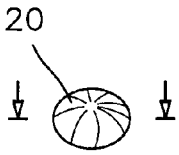
FIG. 65 shows an applicator endpiece that is suitable for the heater in FIGS. 63 and 64.
Figure 66:
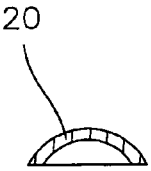
FIG. 66 is a section in a mid-plane of the FIG. 65 applicator endpiece.

As shown in FIGS. 63 and 64, the heater 11 can also be made with a heating surface 500 that is dome shaped, e.g. projecting from one side of a flat stem 300.

The applicator endpiece 20 can have a spherical-cap shape in order to come into close contact with the heating surface 500.

Figure 67:
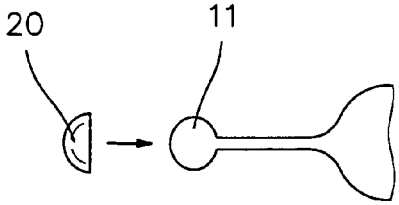
FIG. 67 shows a variant heater and associated applicator endpiece.

In the FIG. 67 embodiment, the heater 11 presents a ball shape, and the endpiece has, for example, a substantially complementary hollow shape in order to fit thereon, either axially, or via the side.

Figure 68:
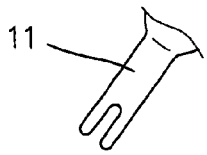
FIG. 68 shows a variant heater.

In the variant shown in FIG. 68, the heater has a fork shape. The applicator endpiece 20 can thus have any shape that is adapted to be engaged on and/or between the teeth of the heater 11.

The sheath 30 of the heater can present thickness that varies as a function of position along the longitudinal axis Y of the heater, as shown in FIG. 28, in particular wall thickness that decreases towards the distal end 33, so as to impart a generally conical shape to the outside lateral surface 35, making it easier to extract the applicator endpiece 20.

Figure 52:
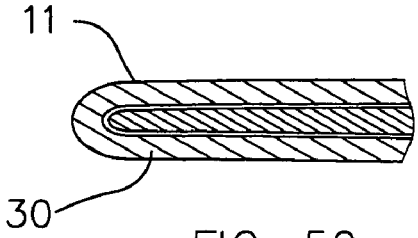

The variation in the thickness of the wall of the sheath 30 can be selected as a function of the surface temperature to be reached, e.g. as a function of the nature and of the position of the heater resistor 15 disposed inside the envelope 30.

Where appropriate, as shown in FIG. 52, the sheath can present wall thickness that is substantially constant over the major fraction of the length of the heater 11.

Figure 53:
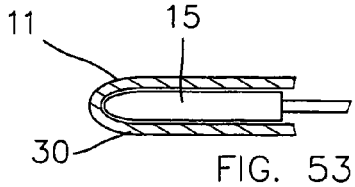
FIGS. 52 to 55 show variant embodiments of the heater.
Figure 54:
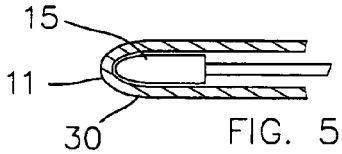

The heater resistor 15 can extend along the entire length of the heater 11 that is covered by the applicator endpiece 20, as shown in FIG. 53. In a variant, the heater resistor 15 can extend over a fraction only of this length, as shown in FIG. 54, e.g. being situated at the end of the heater 11.

By way of example, the heater resistor 15 is inserted into a housing of the sheath with little clearance, so as to improve heat transfer.

Figure 55:
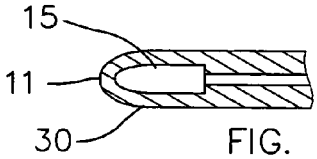

In a variant, the sheath 30 is overmolded on the heater resistor 15, as shown in FIG. 55. In this event, in order to make the sheath 30, it is possible to use a synthetic material such as silicone, e.g. filled with metal particles or with magnesia. The sheath can also be made of PTFE (Teflon®) or covered with PTFE.

The sheath 30 can be rigid or flexible.

In a variant, the sheath 30 is made of glass or ceramic.

The applicator endpiece 20 can be made as a single part from the composition for application to the eyelashes.

Figure 56:
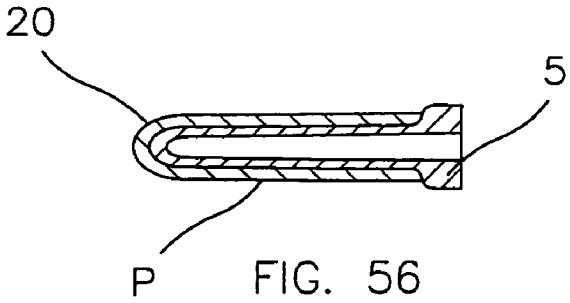
FIG. 56 is a diagrammatic and fragmentary view showing a composite applicator endpiece.

In a variant, the applicator endpiece 20 can be composite, e.g. comprising a substrate S covered by the composition P for application, as shown in FIG. 56.

Figure 57:
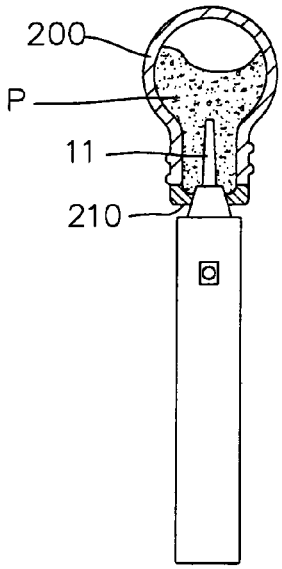
FIGS. 57 to 59 show other embodiments of the invention.
Figure 58:
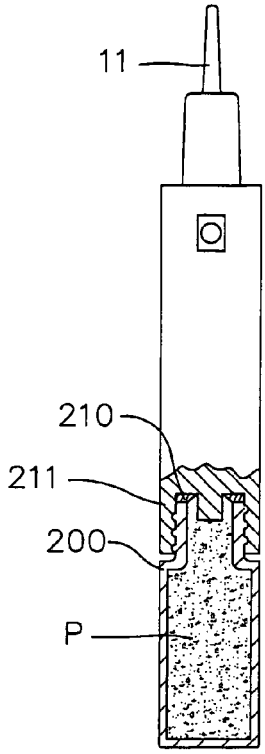

In another embodiment of the invention shown in FIGS. 57 to 60, the composition P for application to the eyelashes is not initially in the form of an endpiece but is in the form of a powder, paste, gel, or liquid contained in a receptacle 200 that can be of any type, and that is shown only very diagrammatically in FIGS. 57 and 58.

In order to load the heater 11 with the composition P, the heater 11 is brought into contact with the composition P, e.g. by dipping the heater 11 into the composition P contained in the receptacle 200, as shown in FIG. 57.

When the composition P is a powder, the heater 11 can be brought to its hot state in contact with the composition P, such that said composition adheres to the heater as a result of it softening or becoming fluid in contact therewith.

Figure 59:
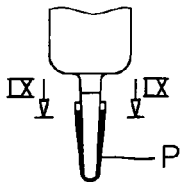
Figure 60:
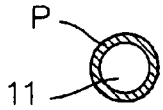
FIG. 60 is a diagrammatic and fragmentary cross-section on LX-LX of FIG. 59.

After removing the heater 11, a layer of composition P remains on the heater 11, as can be seen in FIGS. 59 and 60, surrounding the heater 11 over its entire circumference. The heater 11 coated in this way by the composition can be used in the manner described above with reference to FIGS. 7 to 10.

The heater 11 can also be loaded by being inserted in its cold state into the receptacle 200, then removed from the receptacle while still cold, or it can be switched on in the receptacle.

The composition P can contain a binder, e.g. an oil, for improving the adherence of the composition P on the heater 11, in particular when cold.

The receptacle 200 can advantageously include a gasket 210 that bears against the applicator device when the heater 11 is inserted into the receptacle 200, so as to reduce any risk of composition P being lost in the event of the receptacle 200 being turned upsidedown.

By way of example, the gasket 210 is overmolded on the opening of the receptacle 200, or fastened is in some other way.

In a variant, the gasket 210 is carried by the applicator device.

Where appropriate, and as shown in FIG. 58, the receptacle 200 can be fastened on the applicator device, except while the heater 11 is being loaded with composition P.

By way of example, the applicator device is arranged so as to enable the receptacle to be clogged, and includes a threaded skirt 211 on the side remote from the heater 11, for example.

In a variant not shown, the heater 11 of the applicator device can be used without an applicator endpiece, e.g. for curling the eyelashes by pressing said eyelashes against a surface that has been heated by the heater. By way of example, the heated surface is the outside surface of the heater, or the surface of a curler endpiece that is fitted to the heater.

Examples of compositions are given below.

Naturally, the invention is not limited to a particular composition.

PROPOSED EXAMPLES

Example 1

Mascara was prepared having the following composition:

| | |
|---|---|
| Coolbind 34-1300 of National Starch | 96% |
| Black iron oxide | 4% |

The ingredients were mixed together at 100° C., then left to cool at ambient temperature in a mold in the shape of the endpiece.

A black solid mascara was obtained.

The $d_{max}$ of the composition was measured using the above-specified protocol: the mascara presented a $d_{max}$ of about 35 mm.

Example 2

The Example 1 composition was used but in powder form, e.g. with a grain size lying in the range 1 micrometer (1 μm) to 3 μm, the powder having been formed by abrasion, for example.

A binder such as oil could be added, where appropriate.

When the heater was brought into contact with such a powder, the heater became sheathed by the composition that covered it over a complete turn about its axis.

The invention is not limited to the embodiments described above.

The temperature of the heater can be regulated electronically, or otherwise.

The applicator endpiece can present shapes other than the shapes shown, e.g. tab shaped of section that is rounded in part and of thickness lying in the range 0.2 mm to 2 mm.

In particular, the various characteristics of the various embodiments can be combined together within new variants not shown.

In a variant not shown, the inside of the casing of the applicator device is accessed via the rear, e.g. by means of a hinged wall.

Where appropriate, the kit comprising the applicator device and the applicator endpiece can be proposed to the consumer with a composition for applying to the eyelashes before bringing them into contact with the composition present on the heater, e.g. in order to make them up and/or to reduce the adherence of the threads of composition formed in the extension of the eyelashes.

The kit can also be proposed with a composition for application to the extended eyelashes, e.g. to change their color or to create effects.

The applicator device can include a source of vibration, where appropriate. The source of vibration can be integrated in the device or fitted thereon.

Figure 69:
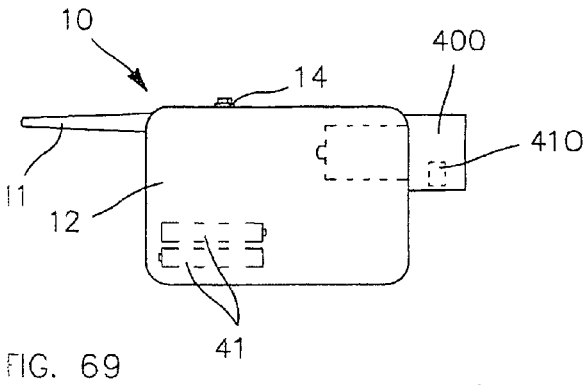
FIG. 69 is a plan view showing a variant applicator device.

FIG. 69 shows a device 10 that is arranged to enable a source of vibration 400 to be fastened thereon. By way of example, the source of vibration is engaged in a housing of the casing 12, so as to transmit vibration that it generates to the heater 11. By way of example, the casing 12 has a flat shape, e.g. generally a rectangular box shape.

The source of vibration 400 can comprise an electric motor 410 that drives an off-center fly-weight, the axis of rotation of the motor being disposed within the source of vibration 400 as a function of the orientation desired for the vibration, e.g. parallel to the longitudinal axis of the heater 11 or transversally to said axis, or in some other orientation.

In FIG. 69 shows the possibility of electrically powering the device 10 by means of two 1.5 V batteries 41 of the round-battery type, for example, but the device 10 can be powered in some other way.

The heater 11 can be electrically powered by means of a switch 14.

By way of example, vibration can be switched on by means of a contactor that is present on the source of vibration 400, for example, and that enables the user to select the operating mode of the device, namely heating with vibration, vibration only, or heating only.

When the source of vibration is integrated in the casing 12 of the device 10, said device can include two switches, one for switching on heating and the other for switching on vibration. In a variant, the device includes only one switch that switches on both functions simultaneously.

Figure 71:
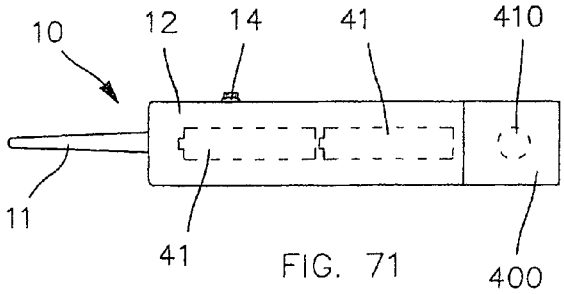
FIG. 71 is a side view of a variant of the device.

The device 10 can be elongate in shape, as shown in FIG. 71, with an electric power supply comprising two round batteries disposed end to end, for example.

The source of vibration 400 can be at the rear of the device, being integrated in said device or constituted by a removable unit, for example.

Application WO 2006/090343, the content of which is incorporated herein by reference, discloses examples of sources of vibration, an example of a removable source of vibration being shown in FIG. 45 of that application.

By way of example, the vibration frequency is greater than or equal to 1 hertz (Hz), e.g. lying in the range 1 Hz to 500 Hz, better in the range 50 Hz to 200 Hz.

By way of example, the speed of rotation of the motor 410 lies in the range 4500 revolutions per minute (rpm) to 12000 rpm.

The motor can be contained in a metal case with the off-center fly-weight, the case being disk shaped, for example.

The amplitude of the vibration of the heater is preferably less than or equal to 5 mm, better less than or equal to 3 mm, with microvibration being preferable.

Figure 72:
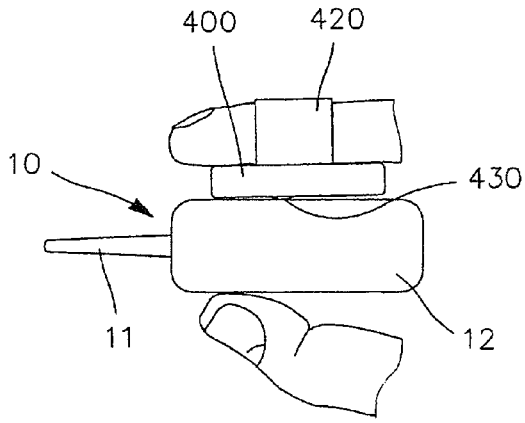
FIG. 72 shows a source of vibration put into contact with the applicator device.
Figure 70:
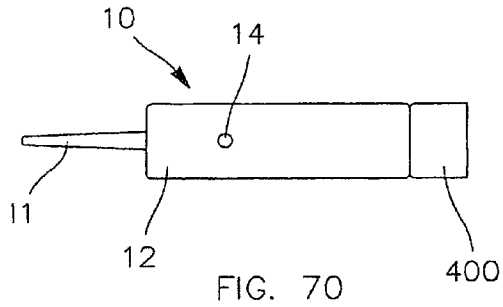
FIG. 70 is a side View of the FIG. 69 device.

FIG. 72 shows the possibility of causing the device 10 to vibrate by means of a source of vibration that is brought temporarily into contact with the device 10, e.g. by pressing against the casing 12.

By way of example, the source of vibration 400 is mounted on a finger of the user by means of a ring 420.

The source of vibration 400 can include a contactor 430 that is actuated when the source is pressed against the object to which it is to transmit vibration.

In the embodiment shown, the contactor 430 is present on the face of the source that is remote from the ring 420, and the user can transmit vibration to the heater 11 by squeezing the applicator device 10 between two fingers, the vibration source being mounted on one of the fingers.

The presence of vibration during application can be useful for controlling the application of the composition more easily, and in particular for breaking the threads of composition that are formed at the ends of the eyelashes at the desired length. By way of example, the user can stretch the threads of composition without vibration, and can trigger vibration when said threads have reached the desired length, in order to break them.

Vibrating the heater can thus make it easier to elongate the eyelashes without necessarily having to stretch the threads of composition quickly, which is an operation that is difficult to reproduce. Vibration can make it easier to break the threads of composition to the desired dimensions.

Figure 73:
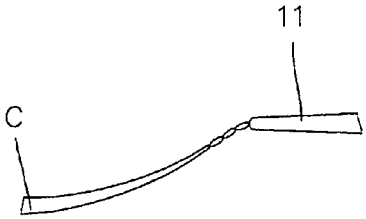
FIG. 73 shows one possibility of making up the eyelashes, amongst others.

By means of the invention, the user can thus form a succession of small batches of substance at the end of the eyelashes, as shown in FIG. 73.

Vibration can encourage the melted composition to adhere to the eyelashes, make lengthening more uniform, and can make it possible to move the hand while applying makeup in a manner that is slower and easier to reproduce.

Vibration can also enlarge the range of temperatures that are acceptable for applying makeup.

The source of vibration can be provided other than by means of a motor that drives an off-center fly-weight, e.g. it can include a motor that drives an eccentric, or a piezoelectric vibrator or an electromechanical vibrator. The source of vibration can comprise a motor that drives a rattle comprising a toothed wheel and a resilient blade that bears against said toothed wheel, for example.

The vibrating source, when it is removable, may carry teeth.

These teeth are for example oriented in a direction opposite from the heater.

The applicator device may also comprise teeth opposite to the heater.

The expression "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A kit comprising:

an applicator device comprising:

a heater; and an applicator endpiece having a shape that is adapted to being fitted to the heater during application to eyelashes;

a composition for application to the eyelashes, said composition presenting at least one property that varies as a function of temperature;

the applicator endpiece comprising the composition prior to fitting of the endpiece to the heater.

2. The kit according to claim 1, the composition being in the form of a compacted powder.

3. The kit according to claim 1, the at least one property that varies as a function of temperature being a thread-forming characteristic of the composition.

4. The kit according to claim 1, the composition presenting a thread-forming characteristic at least when it is heated above 400 C.

5. The kit according to claim 1, the applicator endpiece being made exclusively of the composition for application.

6. The kit according to claim 5, the composition being molded directly with the shape of the applicator endpiece.

7. The kit according to claim 1, the applicator endpiece being composite.

8. The kit according to claim 7, the composition being in the form of an outer coating on the surface of a substrate that is shaped for fitting to the heater.

9. The kit according to claim 1, the heater presenting the shape of a finger.

10. The kit according to claim 1, the applicator endpiece presenting a hollow shape, selected among the shape of a glove finger, a trough, or a dome.

11. The kit according to claim 1, the applicator endpiece being configured to cover the heater over at least a fraction of its length starting from its distal end.

12. The kit according to claim 1, the applicator endpiece being arranged to be fitted sideways onto the heater.

13. The kit according to claim 1, the heater comprising a sheath presenting a housing in which at least one heater resistor is disposed.

14. The kit according to claim 13, the sheath being overmolded on the at least one heater resistor.

15. The kit according to claim 13, the sheath being made of metal, or of a synthetic material containing a filler.

16. The kit according to claim 1, the applicator device including at least one switch for triggering heating of the heater.

17. The kit according to claim 1, the applicator device including a housing making it possible to receive at least one spare applicator endpiece prior to being fitted to the heater.

18. The kit according to claim 1, the source of electricity and the heater being selected such that the heater can reach a surface temperature lying in the range 45° C. to 95° C. in less than 120 seconds, starting from an initial temperature of 25° C. in a closed environment at 25° C.

19. The kit according to claim 1, the heater presenting a shape that is generally tapering.

20. The kit according to claim 1, the heater presenting a surface state and/or surface tension selected such that the composition does not adhere to the heater at 25° C.

21. The kit according to claim 1, the applicator device further comprising a handle portion, the heater being stationary relative to the handle portion of the applicator device.

22. The kit according to claim 1, the applicator device further comprising a handle portion, the heater being movable relative to the handle portion of the applicator device.

23. The kit according to claim 22, the applicator device being arranged such that the displacement of the heater relative to the handle portion causes the applicator endpiece to be ejected from the heater.

24. The kit according to claim 22, the heater being pivotable about its own longitudinal axis or about an axis that does not coincide with its longitudinal axis.

25. The kit according to claim 1, the applicator device including an ejector member that is movable relative to the heater.

26. The kit according to claim 13, the thickness of the sheath decreasing towards the distal end of the heater.

27. The kit according to claim 13, the thickness of the sheath being constant over at least a portion covered by the composition.

28. The kit according to claim 1, the heater presenting an outside surface having a shape that is circular in cross-section.

29. The kit according to claim 1, the heater presenting an outside surface having a shape that is not circular in cross-section.

30. The kit according to claim 1, the heater including longitudinal ridges.

31. The kit according to claim 1, the applicator endpiece being trough-shaped, the heater presenting a top portion and a wide base that is adapted to receive the trough-shaped applicator endpiece.

32. The kit according to claim 1, the heater presenting a spherical heating surface extending from an end of the heater, or extending from a flat surface of the heater.

33. The kit according to claim 1, the applicator endpiece presenting an inside cross-section that is not geometrically similar to the outside cross-section of the heater.

34. The kit according to claim 1, the applicator endpiece presenting a shape that tapers.

35. The kit according to claim 1, the applicator endpiece including a narrow tip.

36. The kit according to claim 1, the applicator endpiece presenting a thickening at its base.

37. The kit according to claim 1, the applicator endpiece presenting, over at least a fraction of its length, a wall thickness that is substantially constant.

38. The kit according to claim 1, including a thread cutter.

39. The kit according to claim 38, the thread cutter being secured to the applicator device or to a protective cap configured to protect the heater.

40. The kit according to claim 2, the applicator endpiece having a shape that is adapted to being inserted axially into a cavity of the heater.

41. The kit according to claim 40, the endpiece being arranged to be fitted at the distal end of the heater so as to cover only the distal end of the heater.

42. The kit according to claim 1, the applicator device and the composition being contained in the same packaging.

43. The kit according to claim 1, the applicator device including a source of vibration.

44. The kit according to claim 43, the source of vibration being fastened in a removable manner on the applicator device.

45. An applicator endpiece in a shape of a stud or with a hollow shape that is open at least at one end so as to enable the applicator endpiece to be put into place on a heater and remain thereon during application to eyelashes, the applicator endpiece comprising a composition for making up the eyelashes prior to placement on the heater and having a property that varies as a function of temperature.

46. The applicator endpiece according to claim 45, the composition being solid at 25° C. and presenting a thread-forming characteristic at 45° C.

47. An applicator device for applying a composition to the eyelashes, comprising:

a heater that is elongate along an axis, and that is configured to receive and retain an applicator endpiece during application to eyelashes, the applicator endpiece comprising a composition for application to the eyelashes prior to being received by the heater, the applicator device being arranged such that, while the heater is in operation, a temperature of the heater lies in the range of 40° C. to 95° C., the heater having a heating surface of a shape that tapers or that is convex.

48. The device according to claim 47, further comprising a source of vibration.

49. A method of making up the eyelashes, the method comprising:

fitting an applicator endpiece to an applicator device including a heater, the applicator endpiece comprising a composition for making up the eyelashes prior to the fitting, and presenting a property that varies as a function of temperature, the applicator endpiece having a hollow shape or a shape of a stud, adapted to being fitted to the heater;

with the heater in a hot state, and with the endpiece in place on the heater, bringing it into contact with the eyelashes, resulting in depositing of the composition on the eyelashes.

50. The method according to claim 49, the composition being deposited starting from the ends of eyelashes that are already coated in another composition.

51. The method according to claim 49, including an operation of cutting threads of composition that are formed extending the eyelashes.

52. The method according to claim 49, in which the heater is set into vibration during application of the composition.

* * * * *